US006954995B2

(12) United States Patent
Kitamura et al.

(10) Patent No.: US 6,954,995 B2
(45) Date of Patent: Oct. 18, 2005

(54) DRYING/WASHING MACHINE

(75) Inventors: Susumu Kitamura, Osaka (JP); Masahiro Satou, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/492,512

(22) PCT Filed: Nov. 5, 2002

(86) PCT No.: PCT/JP02/11539

§ 371 (c)(1),
(2), (4) Date: Apr. 14, 2004

(87) PCT Pub. No.: WO03/040458

PCT Pub. Date: May 15, 2003

(65) Prior Publication Data

US 2004/0216326 A1 Nov. 4, 2004

(30) Foreign Application Priority Data

Nov. 8, 2001 (JP) ..... 2001-343296

(51) Int. Cl.[7] ..... F26B 11/02
(52) U.S. Cl. ..... 34/597; 68/12.06
(58) Field of Search ..... 34/596, 597, 606; 68/12.06, 19.2

(56) References Cited

U.S. PATENT DOCUMENTS 2,406,494 A * 8/1946 Ferris ..... 34/60
4,112,590 A * 9/1978 Muller ..... 34/75
5,435,837 A * 7/1995 Lewis et al. ..... 96/54
6,085,556 A * 7/2000 Moon ..... 68/13 A
6,564,591 B2 * 5/2003 Noyes et al. ..... 68/5 C

FOREIGN PATENT DOCUMENTS

| | | | | |
|---|---|---|---|---|
| DE | 2 333 886 | * | 4/1974 | ..... H01J 61/52 |
| JP | 2001-046486 | | 1/1920 | |
| JP | 61-232899 | | 10/1986 | |
| JP | 2-49698 | * | 2/1990 | ..... D06F 58/04 |
| JP | 3-254795 | * | 3/1990 | ..... D06F 58/04 |
| JP | 3-254796 | | 11/1991 | |
| JP | 5-111595 | | 5/1993 | |
| JP | 10-71291 | | 3/1998 | |
| JP | 10-174800 | | 6/1998 | |
| JP | 2001-87590 | | 4/2001 | |
| JP | 2001-300177 | | 10/2001 | |

OTHER PUBLICATIONS

Fresh Air Curative Effect Related to Ions and Traces of Ozone by Thomas Valone from Explore Magazine copyright 1996.*
Air-Zone web site printed Jan. 19, 2005.*
Taiwanese Patent Office Notification of Decision of Rejection dated Nov. 21, 2003.

* cited by examiner

*Primary Examiner*—Stephen Gravini
(74) *Attorney, Agent, or Firm*—Renner, Otto, Boisselle & Sklar, LLP

(57) ABSTRACT

A washer-dryer has a tub, a drum rotatably disposed inside the tub, and warm air feeding means for feeding warm air to dry laundry put in the drum. The washer-dryer further has an ion generating device that generates ions for sterilizing the laundry. The ion generating device feeds the ions to the drum and the tub. This makes it possible to realize a washer-dryer that can kill germs attached to clothes or floating in circulated air and thereby keep clothes clean.

14 Claims, 5 Drawing Sheets

DRYING/WASHING MACHINE

TECHNICAL FIELD

The present invention relates to a washer-dryer provided with a sterilizing function.

BACKGROUND ART

Conventionally, washer-dryers are used to wash and dry clothes and the like (laundry). FIG. 4 is a side sectional view showing a washing control portion of a conventional drum-type washer-dryer, as an example of such a washer-dryer. In this figure, a body cabinet 1, which forms the outer wall of the drum-type washer-dryer, is openable at its front by means of a door 3. In an upper portion of the front face of the body cabinet 1, there is provided an operation panel 11 provided with operation keys and indicators. Inside the body cabinet 1, there is provided a tub 4 having an opening 4*a* at the front and having the shape of a bottomed cylinder. Inside the tub 4 is disposed a drum 5 having the shape of a bottomed cylinder. Moreover, to the tub 4 is fixed a drive mechanism 9 having a bearing 6 and other components assembled together, so that the drive mechanism 9 is supported by the tub 4.

A shaft 5*e* is fixed to the drum 5, and is supported by the bearing 6, so that the drum 5 is freely rotatable. A rotor 55*e* is firmly fitted to the shaft 5*e*, and a stator 55*d* is fixed inside a motor case 55*f* In this way, a motor 55 is formed that is directly coupled to the drum 5. Moreover, all round the circumferential wall of the drum 5, small holes 5*a* are formed. The small holes 5*a* allow washing water to move between the tub 4 and the drum 5 during washing.

On the inner wall surface of the drum 5, baffles 5*b* are formed so as to protrude therefrom. As the drum 5 rotates, the baffles 5*b* catch and lift up laundry and then let it drop into washing fluid. In this way, washing is achieved. Around the rim of an opening 5*c* at the front of the drum 5, outside it, a fluid balancer 5*d* is provided. The fluid balancer 5*d* has fluid such as salt water sealed therein. As the drum 5 rotates, the fluid moves so as to cancel the shifting of the center of gravity resulting from lopsided distribution of laundry and washing fluid. The fluid balancers 5*d* may be provided around the rim of the opening 5*c* inside the drum 5.

Around the rim of a laundry inlet 1*a* and around the rim of the opening 4*a* of the tub 4, a gasket 10 made of an elastic material such as rubber or soft resin is fitted so as to form a passage through which laundry is put in and taken out. When the door 3 is closed, the inner rim 10*a* of the gasket 10 comes into intimate contact with the rim of the door 3, and thereby closes the passage. This prevents water from leaking out during washing. Moreover, the gasket 10 is pleated like a bellows so as to flexibly follow the swinging movement of the tub 4.

In an upper portion of the body cabinet 1, there is disposed a water feed pipe 12 that is connected to a water pipe of running water. When a water feed valve 13, provided in the middle of the water feed pipe 12, is opened, water is fed, through a detergent case 14 and then through a wafer feed nozzle 15 fitted to the gasket 10, into the tub 4.

From the bottom of the tub 4 runs a water drain duct 16, in the middle of which there are provided a connection case 17, incorporating a lint filter 17*a*, and a water drain pump 18. This permits washing fluid from the tub 4 to be drained out of the body cabinet 1. The lint filter 17*a* is formed as a grid made of resin or a bag formed of a fine-meshed net of fiber, and collects flint or the like in washing fluid. The lint filter

17*a* is removably fitted inside the connection case 17, and can be removed therefrom through a lower front portion of the body cabinet 1.

The top of the connection case 17 is connected through an air trap 22 and a connecting pipe 21 to a water level sensor 23. According to the variation in the pressure inside the air trap 22, the water level sensor 23 moves a magnetic member inside a coil. The resulting variation in the inductance of the coil is detected as variation in oscillation frequency, and thereby the waver level inside the tub 4 is detected. Behind the operation panel 11 is disposed a controller 2, which controls the drum-type washer-dryer.

FIG. 5 is a side sectional view showing a drying control portion of the conventional drum-type washer-dryer described above. Above the tub 4, there is provided a dryer unit 24 for drying laundry. The dryer unit 24 is composed of a blower fan 25 and a heating element 26. The dryer unit 24 is disposed in the middle of a drying duct 27 connecting between a blow opening 4*b* facing the opening 4*a* of the tub 4 and an exhaust opening 4*c* provided at the bottom. In the middle of the drying duct 27 is also provided a cooling element 29.

In the conventional drum-type washer-drier described above, a washing sequence is performed according to instructions from the controller 2. Now, how a washing sequence is performed will be described. When laundry is put in through the laundry inlet 1*a* and the door 3 is closed, the inner rim 10*a* of the gasket 10 comes into intimate contact with the rim of the door 3, and thus the tub 4 is hermetically closed. Then, detergent is put in the detergent case 14, and the operation panel 11 is operated so that, according to instructions from the controller 2, a washing sequence including a "washing process," a "rinsing process," a "water-extracting process," and a "drying process" is started.

First, in the "washing process," water is fed in with the door 3 locked and the water feed valve 13 open. When the water feed valve 13 is opened, running water flows, by way of the detergent case 14 and thus together with detergent and then through the wafer feed nozzle 15, into the tub 4 and the drum 5. When the water level inside the tub 4 reaches a predetermined level, this is detected by the water level sensor 23. Then, the water feed valve 13 is closed, and the drive mechanism 9 is activated to rotate the drum 5 in order to perform washing for a predetermined period of time.

On completion of the "washing process," the "rinsing process" is started, in which water-extraction-accompanied rinsing and agitation-rinsing are performed alternately and repeatedly. In the "rinsing process," first, the water drain pump 18 is activated to perform draining so that washing fluid is discharged through the water drain duct 16 and the connection case 17 out of the body cabinet 1. On completion of draining, the drum 5 is rotated to perform water-extraction-accompanied rinsing. The water-extracting rotation produces a centrifugal force, which drives washing fluid out of laundry and makes it spew out of the drum 5 through the small holes 5*a* formed in the circumferential wall thereof onto the inner wall of the tub 4. The washing fluid then flows down along the inner wall of the tub 4 to the bottom thereof, and is then discharged out through water drain ducts 16*a* and 16*b*.

On completion of water-extraction-accompanied rinsing, water is fed in with the water drain pump 18 deactivated and the water feed valve 13 open again. After the water feed valve 13 is opened, when the water level inside the tub 4 reaches a predetermined level, the water feed valve 13 is closed, and the drive mechanism 9 is activated to rotate the drum 5 in order to perform rinsing. The water-extraction-accompanied rinsing and rinsing described above are repeated a few times to complete the "rinsing process." Then, the "water-extracting process" is started.

In the "water-extracting process," first, the water feed valve 13 is closed, and the water drain pump 18 is activated to perform draining so that washing fluid is discharged out. Then, the drum 5 is rotated to perform finish water extraction. In finish water extraction, the water-extracting rotation makes washing fluid spew out of the drum 5 through the small holes 5*a* formed in the circumferential wall thereof onto the inner wall of the tub 4. Thereafter, the washing fluid flows down along the inner wall of the tub 4 to the bottom thereof, and is then discharged out through the water drain duct 16. On completion of the "water-extracting process," the "drying process" is performed to dry laundry.

In the "drying process," the drum 5 is rotated, and in addition the blower fan 25 and the heating element 26 are activated. Here, as the blower fan 25 operates, air that has absorbed moisture contained in the laundry inside the drum 5 circulates through the small holes 5*a* of the drum 5, the exhaust opening 4*c* of the tub 4, the drying duct 27, the blower fan 25, the heating element 26, and the blow opening 4*b* back into the drum 5. The air containing moisture, while passing through the drying duct 27, is cooled by the cooling element 29 provided therein, so that the moisture condenses. As a result of the moisture condensing, the air inside the drying duct 27 is dehumidified, and reaches the heating element 26 as dry air.

The air heated by the heating element 26 is, as warm air, blown through the blow opening 4*b* into the tub 4, where the air makes contact with laundry again and absorbs moisture. The air is then again sucked through the exhaust opening 4*c* into the drying duct 27, and is cooled by the cooling element 29 and thereby dehumidified. This is repeated to dry laundry. The dryness inside the drum 5 is detected with a dryness sensor, and, when the dryness reaches a predetermined level, the "drying process" is complete. The moisture collected by dehumidification in this "drying process" drips down inside the drying duct 27, and is discharged out through the exhaust opening 4*c* and the water drain duct 16.

In this way, processes of washing, rinsing, water extraction, and drying are performed in sequence to wash and dry laundry. By making appropriate settings from the operation panel 11, it is also possible to perform processes of washing, rinsing, water extraction, and drying individually.

However, in the conventional washer-dryer constructed as described above, although warm air is circulated in the drying process, it is difficult to bring it into contact with laundry uniformly, and therefore a large number of live germs are considered to remain attached to laundry and the interior of the tub. These germs attach to clothes, making them unsanitary.

DISCLOSURE OF THE INVENTION

An object of the present invention is to provide a washer-dryer that can kill germs attached to clothes or floating in circulated air and thereby keep clothes clean.

To achieve the above object, according to the present invention, a washer-dryer including a tub, a drum rotatably disposed inside the tub, and warm air feeding means for feeding warm air to dry laundry put in the drum is characterized by the provision of a sterilizing device that generates sterilizing means for sterilizing the laundry. The sterilizing device may feed the sterilizing means to the drum.

The sterilizing means may be ions, in which case the sterilizing device is an ion generating device. The ion generating device may release the ions into a circulation path through which the warm air is circulated. The ion generating device may be disposed in the circulation path. The ion generating device may be disposed on the upstream side of the warm air feeding means disposed in the circulation path. The ion generating device may be disposed outside the circulation path with an ion release outlet of the ion generating device communicating with the interior of the circulation path.

The ion generating device may be disposed above the tub.

The ion generating device may stop being operated when the ions are fed to the drum for a predetermined period of time.

The ion generating device may stop being operated when washing or drying is started while the ion generating device is being operated in order to perform washing or drying with priority.

The ion generating device may be operated successively or a predetermined period of time after completion of washing or drying.

A cooling-down process may be provided in which the laundry dried by the warm air is cooled down, with the ion generating device operated in the cooling-down process.

A wrinkle-preventing process is provided in which the drum is rotated to prevent wrinkles from developing in the laundry dried by the warm air, with the ion generating device operated in the wrinkle-preventing process.

The ion generating device may be operated every predetermined number of times or every predetermined period of time that washing or drying is performed. The predetermined number of times or the predetermined period of time can freely be set.

A hot-air sterilization process may be provided in which the laundry is sterilized by feeding thereto the warm air at a temperature higher than during drying, with the ion generating device operated successively or a predetermined period of time after completion of the hot-air sterilization process.

Whether to operate the ion generating device or not can be chosen.

The ion generating device may release positive and negative ions.

BEST MODE FOR CARRYING OUT THE INVENTION

Figure 4:
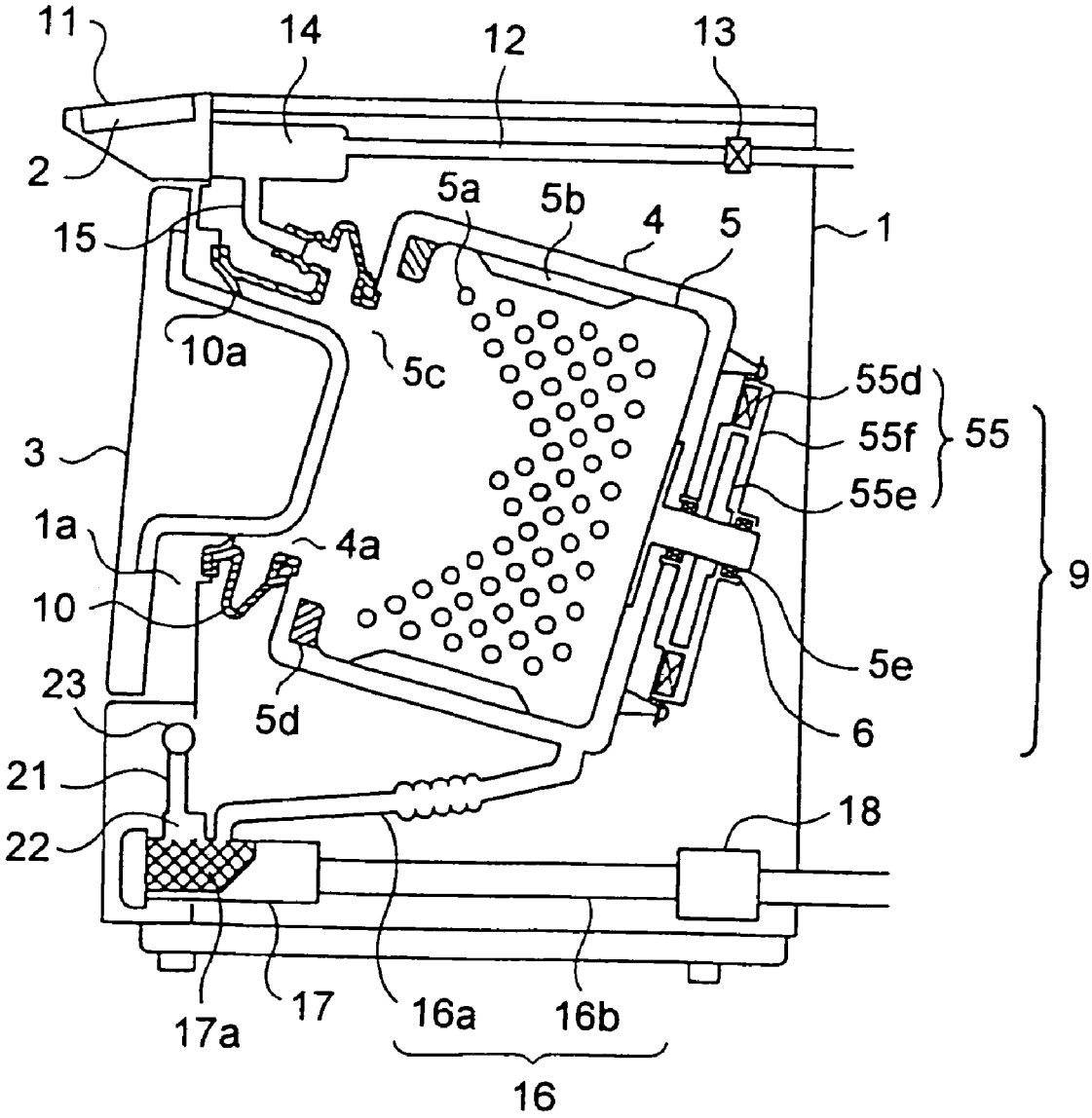
FIG. 4 is a side sectional view showing the washing control portion of a conventional drum-type washer-drier.

Hereinafter, embodiments of the present invention will be described with reference to the drawings. The embodiments described below deal with drum-type washer-driers. However, it is to be understood that the invention may be practiced in any other construction than specifically described below; that is, the same advantages can be achieved by applying the invention to other types of washers, such as full automatic washers with a drum rotating about a vertical axis, clothes dryers, and the like. For convenience' sake, in the figures described below, such components as are found also in the conventional example described earlier are identified with the same reference numerals. Moreover, in the embodiments described below, the construction for controlling washing is the same as in the conventional example shown in FIG. 4 and described earlier.

Figure 1:
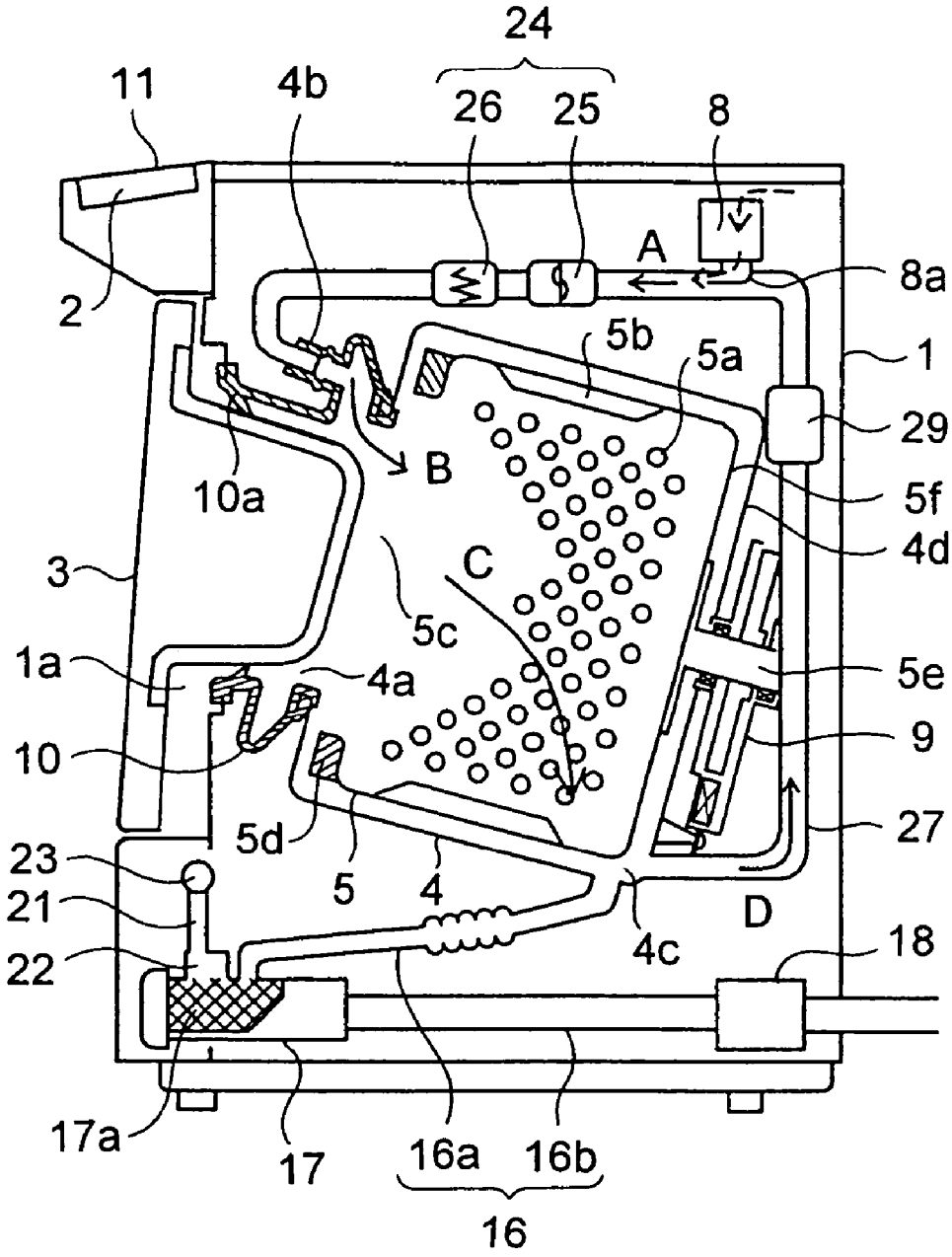
FIG. 1 is a side sectional view showing the drying control portion of a drum-type washer-dryer embodying the invention.
Figure 5:
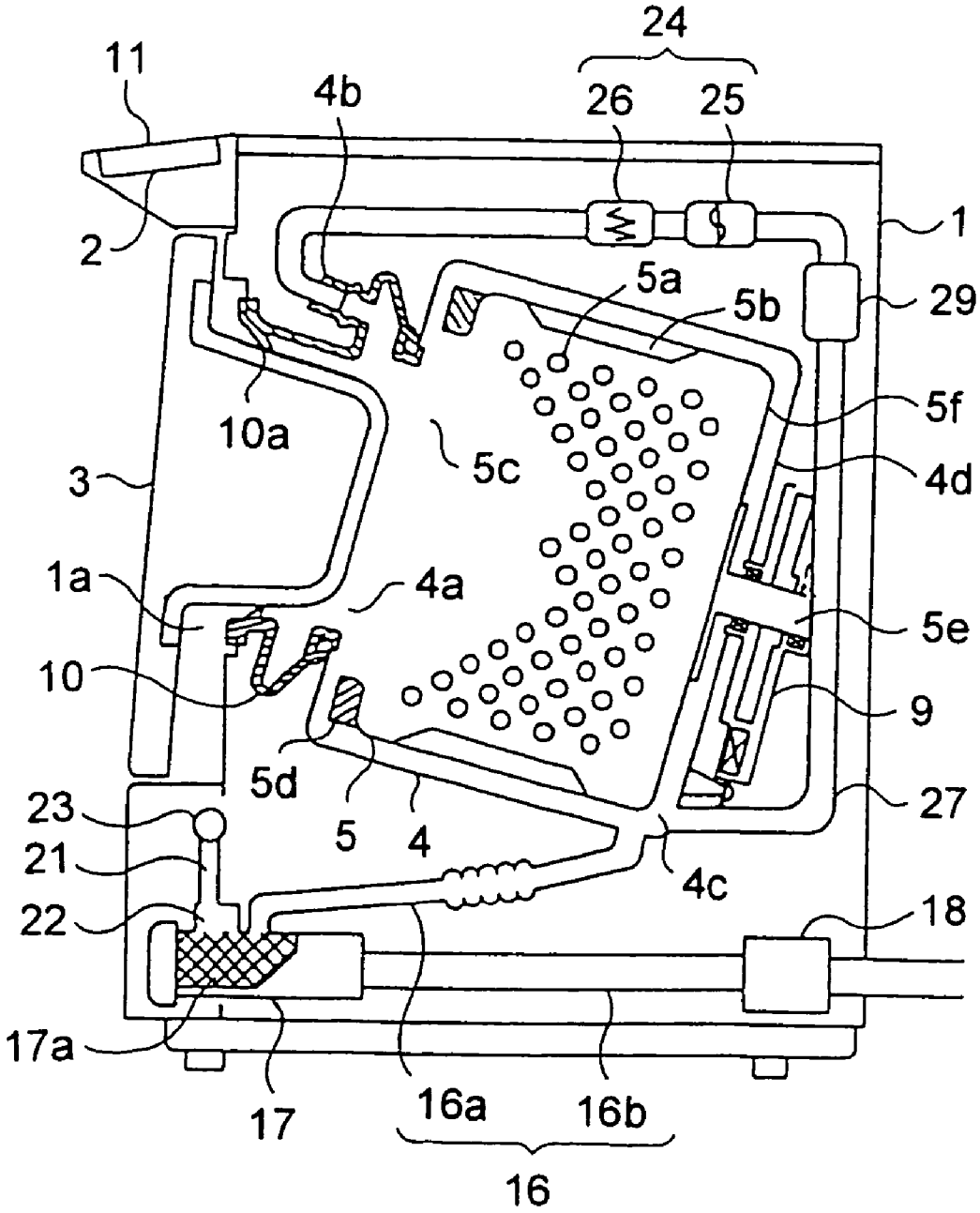
FIG. 5 is a side sectional view showing the drying control portion of the conventional drum-type washer-drier.

FIG. 1 is a side sectional view showing the drying control portion of a drum-type washer-dryer embodying the invention. As shown in the figure, just as in the conventional example shown in FIG. 5 and described earlier, above the tub 4 is provided a dryer unit 24 for drying laundry which is composed of a blower fan 25 and a heating element 26. The dryer unit 24 is disposed in the middle of a drying duct 27 connecting between a blow opening 4*b* facing the opening 4*a* of the tub 4 and an exhaust opening 4*c* provided at the bottom. In the middle of the drying duct 27 is also provided a cooling element 29. During drying, air is circulated through the drying duct and the drum 5 as indicated by arrows A, B, C, and D in the figure.

In the middle of the drying duct 27, on the upstream side of the heating element 26, there is provided an ion generating device 8, which serves as a sterilizing device. The purpose of disposing the ion generating device 8 on the upstream side of the heating element 26 is to avoid exposing it to high temperatures. To further avoid high temperatures, as shown in the figure, the ion generating device 8 is disposed outside the drying duct 27, and the ion release outlet 8*a* of the former, described later, is so located as to communicate with the interior of the drying duct 27. Moreover, the ion release outlet 8*a* is disposed on the downstream side of the cooling element 29. This helps prevent deterioration of the ion generating device 8 resulting from high temperatures and thereby enhance its reliability. The ions generated by the ion generating device 8 is fed through the drying duct 27 into the drum 5 and the tub 4. When the ions have been fed for a predetermined period of time, the ion generating device 8 stops being operated.

Incidentally, the ion generating device 8 generates positive and negative ions, and releases them into the air to kill airborne bacteria floating in the air. Specifically, for example, when a high alternating-current voltage is applied between electrodes, electric discharge causes ionization in the atmosphere, generating positive and negative ions. Here, for example, $H^+(H_2O)_n$ and $O_2^-(H_2O)_n$ are generated as positive and negative ions, respectively. These ions, when positive or negative alone, have no special effect on airborne bacteria. However, when positive and negative ions are generated simultaneously, through a chemical reaction they produce a radical, which surrounds and eliminates airborne bacteria.

Figure 2:
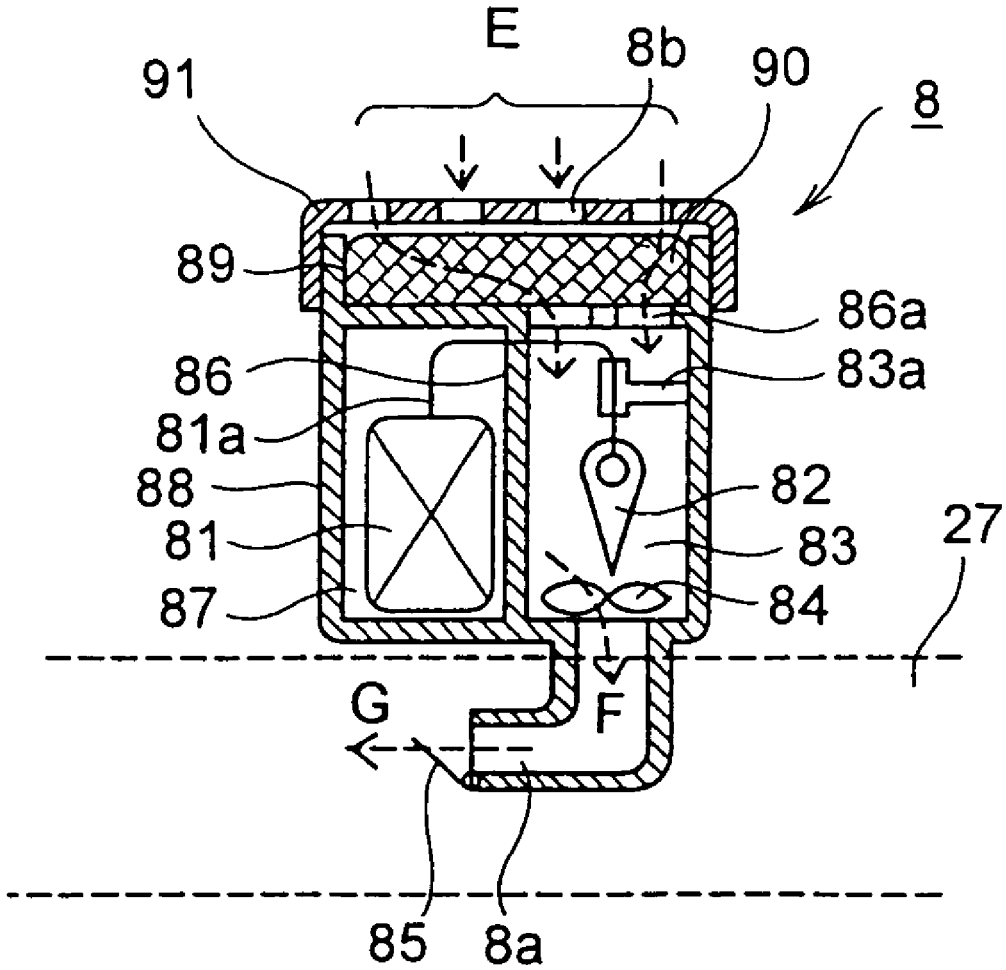
FIG. 2 is an enlarged side sectional view showing the internal construction of the ion generating device.

FIG. 2 is an enlarged side sectional view showing the internal construction of the ion generating device. As shown in this figure, the ion generating device 8 has a body casing 88, which has an ion release outlet 8*a* formed at the bottom and which has its interior separated, with partition walls 86, into a front chamber 87 and a rear chamber 83 located at the front and the rear and an upper chamber 89 located above those two chambers and communicating only with the rear chamber 83 through communication openings 86*a*.

In the front chamber 87, an ion generating circuit 81 is disposed. On the other hand, in the rear chamber 83, which serves as an ion generation chamber, there is disposed a needle electrode 82, which serves as an ion generating element. The needle electrode 82 has its tip formed into the shape of a needle, and is located so as to face the ion release outlet 8*a*. From the ion generating circuit 81 runs a conductor lead 81*a* formed out of a solid lead. The conductor lead 81*a* penetrates the partition wall 86 to enter the rear chamber 83.

Inside the rear chamber 83, the conductor lead 81*a* is supported by a bracket 83*a* fitted to the wall surface and made of an insulating material such as synthetic resin. Below the bracket 83*a*, the conductor lead 81*a* is, at its tip, electrically and mechanically connected to the needle electrode 82, with its needle-shaped tip down. In this way, the needle electrode 82 is, in its upper portion, supported by the bracket 83*a*, and is thereby held stably in position. In a case where the conductor lead 81*a* is formed out of twisted leads, the needle electrode 82 may be supported directly by the bracket 83*a*. In the upper chamber 89, a filter 90 is disposed.

In the ion generating device 8 constructed as described above, the ion release outlet 8*a* is disposed inside the drying duct 27 so as to point in the direction of the flow of air. The filter 90 provided in the upper chamber 89 faces a large number of air inlet openings 8*b* formed above. The air inlet openings 8*b* are formed all over the surface of a lid-shaped cover 91 that covers the filter 90 housed in the upper chamber 89, and are open to the atmosphere.

As the blower fan 25 sucks air through the drying duct 27, air enters the ion generating device 8 through the air inlet openings 8*b*, passes through the ion generating device 8, and then flows out of it through the ion release outlet 8*a* as indicated by arrows E, F, and G. Meanwhile, the ions released from the needle electrode 82, together with the air, flows out through the ion release outlet 8*a*. Below the needle electrode 82 is provided an ion release fan 84, which helps feed ions stably into the drying duct 27. At the tip of the ion release outlet 8*a*, a valve 85 is provided so that, when the ion generating device 8 is not operated, the ion release outlet 8*a* is closed by the valve 85.

Figure 3:
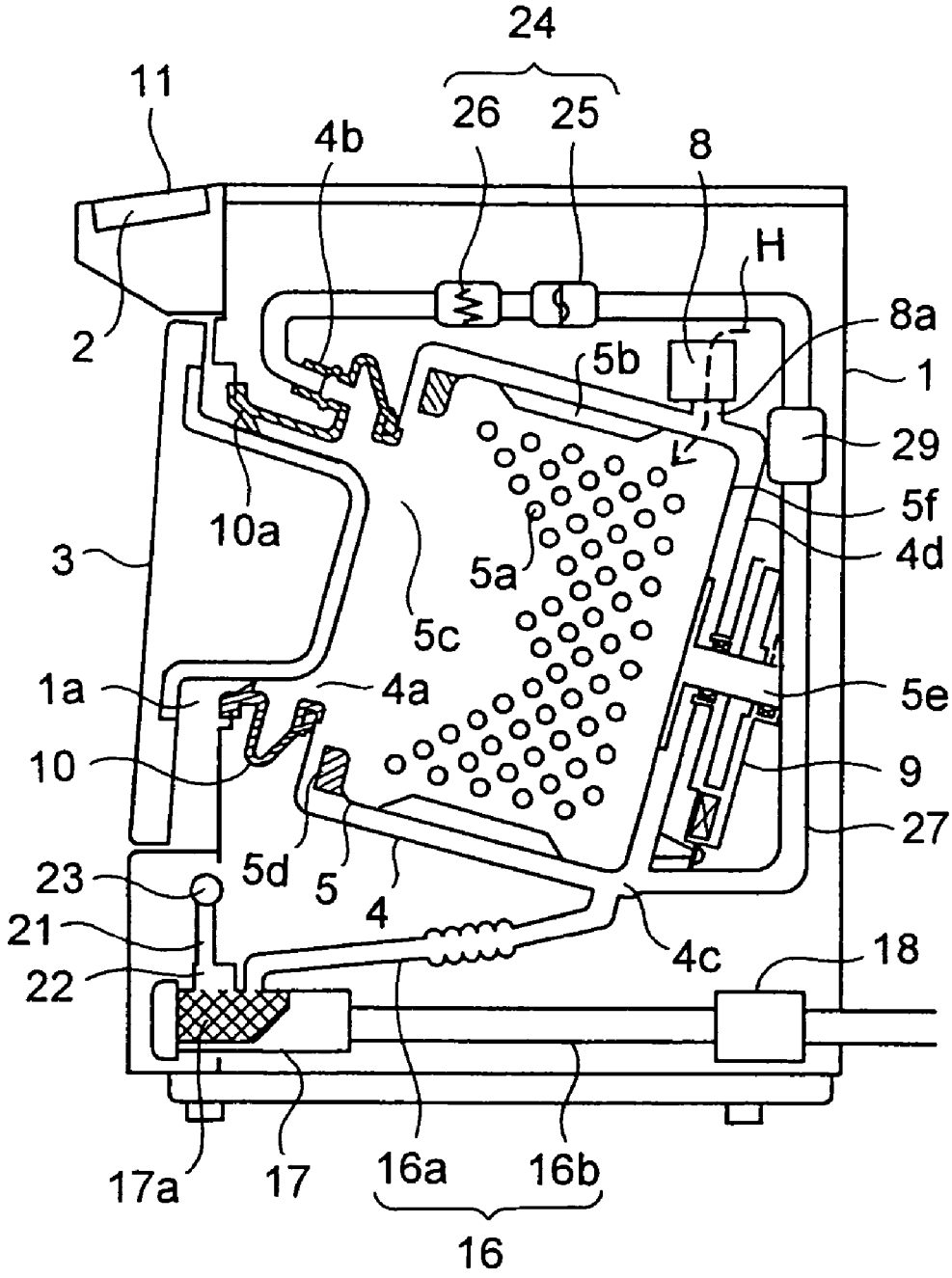
FIG. 3 is a side sectional view showing the drying control portion of another drum-type washer-dryer embodying the invention.

FIG. 3 is a side sectional view showing the drying control portion of another drum-type washer-dryer embodying the invention. As shown in the figure, here, the ion release outlet 8*a* of the ion generating device 8 communicates with the tub 4. As indicated by an arrow H, this permits air to flow through the ion generating device 8 into the tub 4, and thus permits ions to be fed together therewith into the drum 5. Thus, it is possible to achieve the same effect as in the construction shown in FIG. 1.

Next, when to operate the ion generating device 8 will be described. In the following descriptions, a washing course includes a "washing process," a "rinsing process," and a "water-extracting process," and a drying course includes a "drying process," a "cooling-down process," a "wrinkle-preventing process," and a "hot-air sterilization process." Moreover, washing operation denotes operation performed to go through a washing course, and drying operation denotes operation performed to go through a drying process.

During drying operation in a washer-dryer as described above as embodiments, or during washing operation in an electric washer that can perform only washing operation, the ion generating device 8 can be operated intermittently or continuously to feed ions into the drum 5. However, during washing operation or drying operation, humidity is high, and, in particular during drying operation, both temperature and humidity are high. This diminishes the sterilizing effect. Therefore, it is advisable to operate the ion generating device 8 and feed ions into the drum 5 after completion of washing or drying operation and in addition after lowing humidity and temperature.

For example, immediately after completion of drying operation, clothes are hot. Therefore, to cool down the clothes, a "cooling-down process" is performed in which the drum 5 is rotated without energizing the heating element 26 so that cool air is fed into the drum 5. During this "cooling-down process," the ion generating device 8 is operated to feed ions into the drum 5.

Alternatively, to prevent wrinkles from developing in clothes left inside the drum 5 after completion of drying operation, a "wrinkle-preventing process" is performed in which the drum 5 is rotated until the user takes out the clothes. During this "wrinkle-preventing process," the ion generating device 8 is operated to feed ions into the drum 5. In the "wrinkle-preventing process," for example, a cycle in which the drum 5 is kept at rest for two minutes and then rotated for five seconds is repeated, for example, for two hours. Thus, during the "wrinkle-preventing process," clothes are swung inside the drum 5, and this makes it possible to sterilize the clothes uniformly.

Alternatively, the ion generating device 8 may be operated every predetermined number of times or every predetermined period of time that drying operation is performed. Here, the predetermined number of times or the predetermined period of time can freely be set.

Alternatively, the ion generating device 8 may be operated to feed ions into the drum 5 after completion of a "hot-air sterilization process." In the "drying process" mentioned above, the temperature of the circulated air is so controlled as not to damage clothes with heat, for example at about 60° around the exhaust opening 4*c*. By contrast, in the "hot-air sterilization process," it is controlled to be at about 80° C. to achieve sterilization.

Specifically, in this "hot-air sterilization process," temperature is kept at about 80° C. for about five minutes. In addition, the process includes also a period of time required for temperature to reach 80° C. and a period of time required for temperature to fall therefrom to a safe temperature, lasting about 60 minutes in total. Meanwhile, it is advisable to rotate the drum 5 once in a while. Even at about 80° C., however, some germs remain alive. Therefore, after completion of the "hot-air sterilization process," sterilization is performed with ions.

However, even when a sterilization process like this is in the process of being performed, as soon as starting of a washing or drying course is requested, ions stop being fed, and washing or drying operation is performed with priority. Whether to perform a sterilization process or not, i.e., whether a sterilization process is needed or not, can be chosen by operating unillustrated selection keys on the operation panel 11.

What is called the warm air feeding means in the appended claims corresponds to the dryer unit or heating element, and what is called the circulation path there corresponds to the drying duct.

Obviously, many modifications and variations of the present invention are possible in light of the above teachings. It is therefore to be understood that within the scope of the appended claims, the invention may be practiced other than as specifically described.

INDUSTRIAL APPLICABILITY

As described above, according to the present invention, it is possible to provide a washer-dryer that can kill germs attached to clothes or floating in circulated air and thereby keep clothes clean.

Specifically, a sterilizing device is provided to sterilize the interior of the washer-dryer. Moreover, sterilizing means is fed into the drum to kill germs in the drum and make it hygienic. That is, it is possible to kill germs attached to laundry and those that have scattered therefrom and are floating in circulated air, and thereby keep the laundry clean. Moreover, it is also possible to prevent scattering of germs and mold attached to the drum, tub, door gasket, and other components of the washer-dryer.

An ion generating device may be used as the sterilizing device. This makes it easy to control generation of ions acting as the sterilizing means.

The ion generating device may release ions into a circulation path. This permits ions to be fed through the circulation path. The ion generating device may be disposed in the circulation path or above the tub. This eliminates the need to use an extra fitting component for the ion generating device or add an ion feed path, and thus makes it possible to adapt existing products with simple modifications and thus at low prices.

The ion generating device may be disposed on the upstream side of warm air feeding means. This permits the ion generating device to be disposed where temperature is low and thereby prevent deterioration of and damage to the ion generating device, leading to long-term reliability.

The ion generating device may be disposed outside the circulation path with its ion release outlet communicating with the interior of the circulation path. This, too, helps prevent deterioration of and damage to the ion generating device, leading to long-term reliability. Moreover, by opening and closing a valve provided at the tip of the ion release outlet, it is possible to prevent the interior of the ion generating device from being exposed to hot air and thereby further enhance reliability. Furthermore, in these constructions, the ion generating device can be disposed near the opening of the drum. This enhances the sterilizing effect.

The ion generating device may stop being operated when ions have been fed into the drum for a predetermined period of time. This permits the ion generating device to stop operating when it has operated for a predetermined period of time, and thus enhances safety. Moreover, it is not necessary to bother to stop the operation of the ion generating device. This enhances usability.

The operation of the ion generating device may be stopped when, while it is being operated, washing or drying operation is started so that washing or drying operation is performed with priority. This permits washing or drying operation to be performed without waiting for the ion generating device to be stopped, and thus enhances usability.

The ion generating device may be operated successively or a predetermined period of time after completion of washing or drying operation. This permits sterilization to be performed every time the washer-dryer is used, and thus helps keep it hygienic.

The ion generating device may be operated in a cooling-down process. This permits ions to be fed in together with cool circulated air, and thus helps reduce the rise in the temperature of the ion generating device and prevent deterioration thereof, leading to long-term reliability. Moreover, energization of the heating element by the warm air feeding means and operation of the ion generating device do not take place simultaneously. This reduces the current flowing through the power cable or the like, and thus permits the washer-dryer to operate from a rather low-capacity outlet.

The ion generating device may be operated in a wrinkle-preventing process. This permits ions to be fed in uniformly for a long period of time, and thus enhances the sterilizing effect.

The ion generating device may be operated every predetermined number of times or every predetermined period of time that washing or drying operation is performed. This helps eliminate unnecessary sterilization processes, and save the user from making settings for a sterilization process every time he or she uses the washer-drier, enhancing usability. The predetermined number of times or the predetermined period of time can freely be set. This permits the user to decide by him or herself how often to perform a sterilization process, and thus helps reduce operation time and electric power consumption.

The ion generating device may be operated successively or a predetermined period of time after completion of a hot-air sterilization process. The synergy between this process and the operation of the ion generating device further enhances the sterilizing effect.

Whether to operate the ion generating device or not can be chosen. This permits the user to decide by him or herself whether to perform a sterilization process or not, and thus helps reduce operation time and electric power consumption.

The ion generating device may be designed to release positive and negative ions. This further enhances the sterilizing effect.

What is claimed is:

1. A washer-dryer comprising a tub, a drum rotatably disposed inside the tub, and warm air feeding means for feeding warm air to dry laundry put in the drum, wherein a sterilizing device is provided that generates sterilizing means for killing airborne bacteria floating inside the drum, the sterilizing device is an ion generating device that feeds ions as the sterilizing means to the drum, and discharges positive and negative ions, the ion generating device releases the ions into a circulation path through which the air is circulated, and the ion generating device is disposed in the circulation path.

2. The washer-dryer according to claim 1, wherein the ion generating device generates $H^+(H_2O)_n$ as the positive ions and $O_2^-(H_2O)_n$ as the negative ions.

3. The washer-dryer according to claim 1, wherein the ion generating device is disposed on an upstream side of the warm air feeding means disposed in the circulation path.

4. The washer-dryer according to claim 3, wherein the ion generating device is disposed outside the circulation path with an ion release outlet of the ion generating device communicating with an interior of the circulation path.

5. The washer-dryer according to claim 1, wherein the ion generating device is disposed above the tub.

6. The washer-dryer according to claim 1, wherein, when the ions are fed to the drum for a predetermined period of time, the ion generating device stops being operated.

7. The washer-dryer according to claim 1, wherein, when washing or drying is started while the ion generating device is being operated, the ion generating device stops being operated to perform washing or drying with priority.

8. The washer-dryer according to claim 1, wherein, successively or a predetermined period of time after completion of washing or drying, the ion generating device is operated.

9. The washer-dryer according to claim 1, wherein a cooling-down process is provided in which the laundry dried by the warm air is cooled down, and the ion generating device is operated in the cooling-down process.

10. The washer-dryer according to claim 1, wherein a wrinkle-preventing process is provided in which the drum is rotated to prevent wrinkles from developing in the laundry dried by the warm air, and the ion generating device is operated in the wrinkle-preventing process.

11. The washer-dryer according to claim 1, wherein, every predetermined number of times or every predetermined period of time that washing or drying is performed, the ion generating device is operated.

12. The washer-dryer according to claim 11, wherein the predetermined number of times or the predetermined period of time can freely be set.

13. The washer-dryer according to claim 1, wherein a hot-air sterilization process is provided in which the laundry is sterilized by feeding thereto the warm air at a temperature higher than during drying, and, successively or a predetermined period of time after completion of the hot-air sterilization process, the ion generating device is operated.

14. The washer-dryer according to claim 1, wherein whether to operate the ion generating device or not can be chosen.

* * * * *